US008342862B2

(12) United States Patent
Konersmann et al.

(10) Patent No.: US 8,342,862 B2
(45) Date of Patent: Jan. 1, 2013

(54) MOVEABLE EARTH PIN FOR LARGE FORM FACTOR POWER CONNECTORS

(75) Inventors: Roland Konersmann, Georgsmarienhuette (DE); Andreas Kniesel, Muenster (DE)

(73) Assignee: Flextronics AP, LLC, Broomfield, CO (US)

( * ) Notice: Subject to any disclaimer, the term of this patent is extended or adjusted under 35 U.S.C. 154(b) by 123 days.

(21) Appl. No.: 12/947,207

(22) Filed: Nov. 16, 2010

(65) Prior Publication Data

US 2012/0122327 A1 May 17, 2012

(51) Int. Cl.
*H01R 13/648* (2006.01)

(52) U.S. Cl. ..... 439/103; 439/171

(58) Field of Classification Search ..... 439/103–106, 439/171–172

See application file for complete search history.

(56) References Cited

U.S. PATENT DOCUMENTS 4,078,848 A * 3/1978 Blairsdale ..... 439/103
5,075,821 A 12/1991 McDonnal
5,641,292 A * 6/1997 Fann ..... 439/103
6,053,750 A * 4/2000 Waible ..... 439/106
6,247,941 B1 * 6/2001 Lee et al. ..... 439/105
6,452,362 B1 9/2002 Choo
7,160,124 B2 * 1/2007 Bhutani ..... 439/103
7,425,132 B2 * 9/2008 Yang et al. ..... 439/4
2004/0008532 A1 1/2004 Asawa
2004/0263123 A1 12/2004 Breen et al.
2005/0024016 A1 2/2005 Breen et al.
2005/0138437 A1 6/2005 Allen et al.
2006/0022637 A1 2/2006 Wang et al.
2007/0018947 A1 1/2007 Toro-Lira
2007/0079153 A1 4/2007 Bain et al.

* cited by examiner

*Primary Examiner* — Truc Nguyen

(74) *Attorney, Agent, or Firm* — Haverstock & Owens LLP

(57) ABSTRACT

A power connector comprises a slidably positionable earth pin. The earth pin is able to be positioned in a travel, or small form factor and in an operational form factor. The housing of the connector comprises a member having a slot that defines a sliding path for the earth pin. The member also has two sets of grooves for receiving a set of spring loaded protrusions on the earth pin. The protrusions come to rest in one of the sets of grooves thereby defining a small form factor and an operational form factor.

12 Claims, 13 Drawing Sheets

MOVEABLE EARTH PIN FOR LARGE FORM FACTOR POWER CONNECTORS

FIELD OF THE INVENTION

The present invention relates to the field of power socket connectors. More specifically, the present invention relates to large form factor power socket connectors with earth pins.

BACKGROUND OF THE INVENTION

FIG. 1 shows front and side views of a "Type G" power plug. The Type G power plug 100 is also known as the British Standards 1363 (BS 1363) plug or as the "13-amp plug." The BS 1363 is a large plug that has three rectangular prongs forming a triangle. BS 1363 defines the live 110 and neutral 120 as 18 mm long and spaced 22 mm apart, with 9 mm of insulation at the trailing ends of the prongs prevents accidental contact with a bare connector while the plug is partially inserted. The earth pin 130 is approximately 4 by 8 mm and 23 mm long. It should be noted that the housing of the plug 100 is limited in how small of a form factor is possible, since the earth pin 130 is 22 mm in an orthogonal position relative to a line defined by the live 110 and neutral 120 pins.

The Type G design is used not only in the United Kingdom, but also in Ireland, Sri Lanka, Bahrain, UAE, Qatar, Yemen, Oman, Jordan, Cyprus, Malta, Gibraltar, Botswana, Ghana, Hong Kong, Macau, Brunei, Malaysia, Singapore, Indonesia, Bangladesh, Kenya, Uganda, Malawi, Nigeria, Mauritius, Iraq, Kuwait, Tanzania, Zambia and Zimbabwe. BS 1363 is also standard in several of the former British Caribbean colonies such as Belize, Dominica, St. Lucia, Saint Vincent and the Grenadines and Grenada. It is also used in Saudi Arabia in 230 V installations although 110 V installations using a NEMA connector are more common.

Although the BS 1363 connector is generally accepted as the safest power connector plug, it is also generally derided as cumbersome and large. Frequently, those in the countries that have adopted BS 1363 notice that in certain applications, the connector is larger than the device that is being plugged in. This is especially true in portable, rechargeable devices. The BS 1363 connector is bulkier than the most popular mobile devices, such as the Apple iPhone, Sony's PSP, and RIM's various Blackberry models. One prior art solution offers a rotatable earth pin that makes only a small contact with an internal earth contactor when the earth pin is rotated into an operational form factor.

SUMMARY OF THE INVENTION

A power connector in accordance with the present invention conforms to BS 1363 while retaining a small form factor. Advantageously, the power connector includes an earth pin that is slidably coupled to the main housing. Because of the slidable positioning, a robust earth or ground connection is able to be made between the earth pin and a ground contactor within the housing of the plug. A user is able to latch the earth pin in a small form factor position that significantly reduces the volume consumed by the connector. The user is later able to position the earth pin in an operational form factor wherein the prongs are positioned in the BS 1363 arrangement described above. Although the BS 1363 standard is described herein, the notion of a slidably positionable pin for reducing the overall form factor of a connector is generally envisioned. For the sake of brevity and clarity, only the BS 1363 is discussed. However, a person of ordinary skill having the benefit of this disclosure will appreciate that the invention is able to be applied to a great variety of connectors.

In a first aspect of the invention, a connector for a wall power socket comprises a housing having a surface for facing a wall power socket. Positive, negative and earth pins extend outwardly from the housing, wherein the earth pin is slidably positionable in a first and a second position. Preferably, the earth pin extends outwardly from the surface for facing a wall power socket in both the first and the second position. In the first position, the connector is in a small form factor. In the second position, the connector is in an operational form factor. In some embodiments, the housing comprises a member for effectuating a sliding motion, having a slot for defining a sliding path for the earth pin. Within the slot, the housing has a first set of grooves for holding the earth pin in the first position, and a second set of grooves for holding the earth pin in the second position. The member further comprises an elongated groove positioned between the first and second set of grooves. In order to cooperate with the sets of grooves, the earth pin comprises a spring mechanism having a set of protrusions, wherein the protrusions are configured to fit into one of the first and second sets of grooves, thereby selectively holding the earth pin in the first and the second position. The set of protrusions is configured to enable a sliding motion along the set of grooves. Preferably, the earth pin comprises a stopping protrusion, and the connector housing has a locking edge along a sliding path for preventing unwanted motion of the earth pin.

In another aspect of the invention, a system comprises an electrical appliance having a Type G power plug connector. Preferably, the connector has a housing and a positive lead, a negative lead, and an earth pin extending outwardly from the housing, wherein the earth pin is slidably settable in two discrete positions. In some embodiments, the housing of the connector comprises a latching mechanism configured to hold the earth pin in the two discrete positions. Also, the latching mechanism comprises a first set of grooves along a sliding path for holding the earth pin in a first position, and a second set of grooves along the sliding path for holding the earth pin in a second position. To cooperate with the sets of grooves, the earth pin comprises a spring mechanism having a spring actuated set of protrusions for coming to rest in one of the first and second sets of grooves. In some embodiments, the earth pin comprises a locking edge, and the housing comprises a stopping edge along the sliding path for stopping the earth pin from unintended movement.

DETAILED DESCRIPTION OF THE DRAWINGS

Embodiments of the connection system enable a user to slidably position an earth pin of a power plug such that the power plug is in a small form factor with respect to an operational position. Though the discussion that follows generally describes a "Type G" connector in accordance with the BS 1363 standard, also known as the "13 Amp" connector, it will be apparent to the person of ordinary skill having the benefit of this disclosure that the invention may be applied to the several form factors of power connectors and other multi pronged connectors in use throughout the world.

Figure 1:
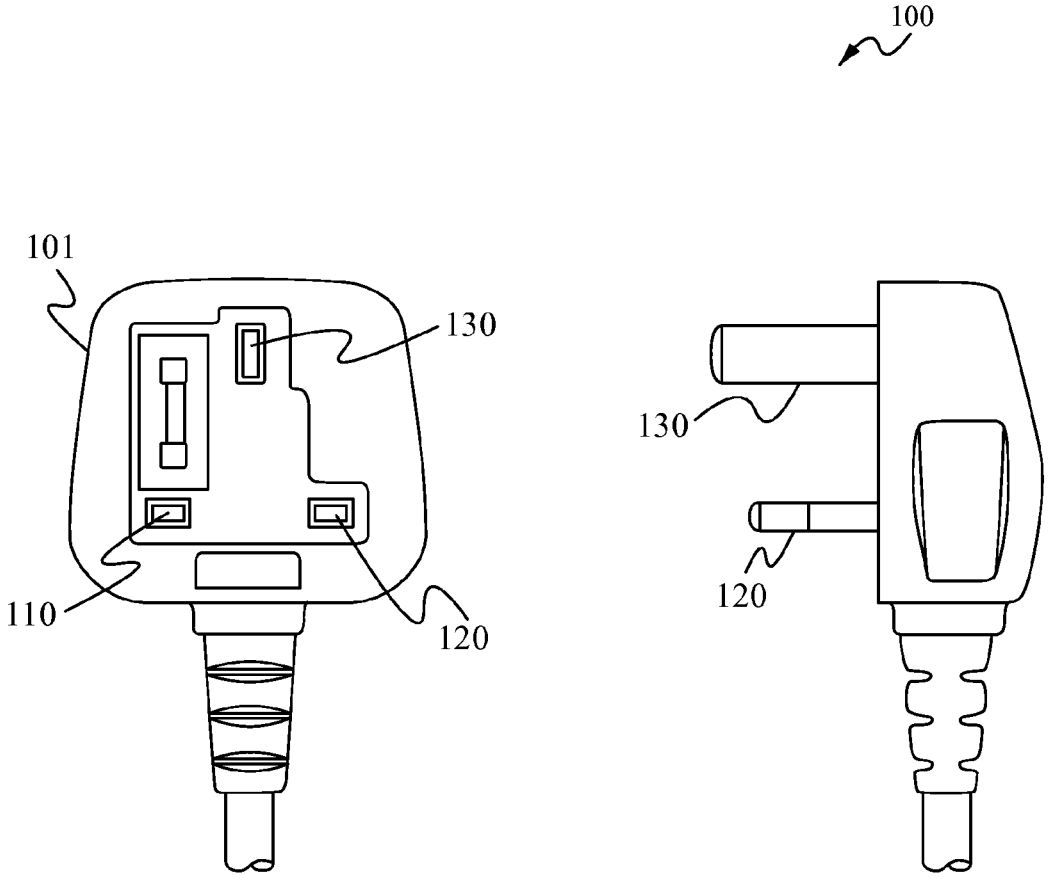
Fig. 1 (Prior Art)
FIG. 1 shows a prior art Type G power connector per BS 1363
Figure 2A:
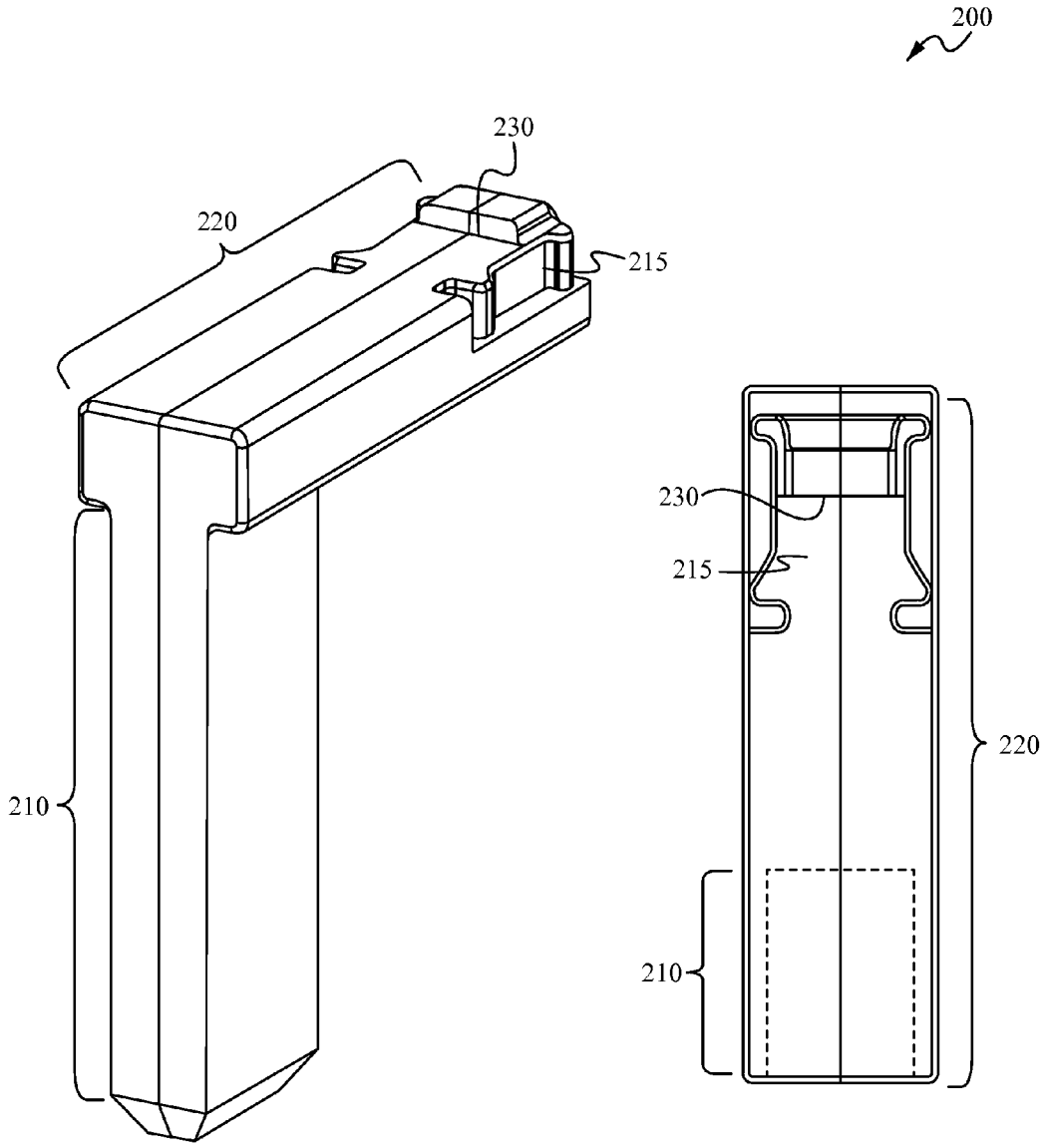
FIG. 2A shows an earth pin of a Type G power connector per an embodiment of the current invention.
Figure 2B:
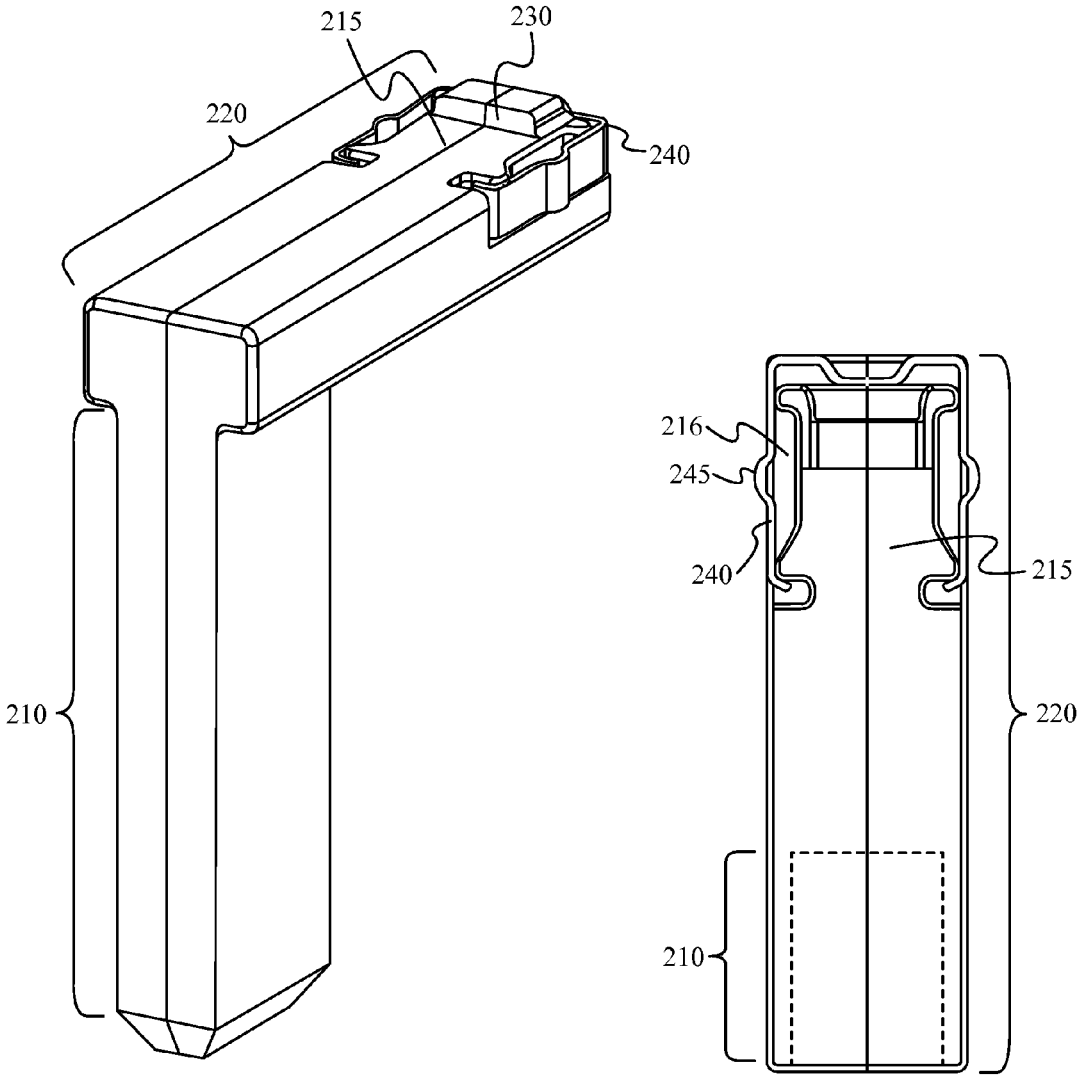
FIG. 2B shows an earth pin of a Type G power connector per an embodiment of the current invention.
Figure 3:
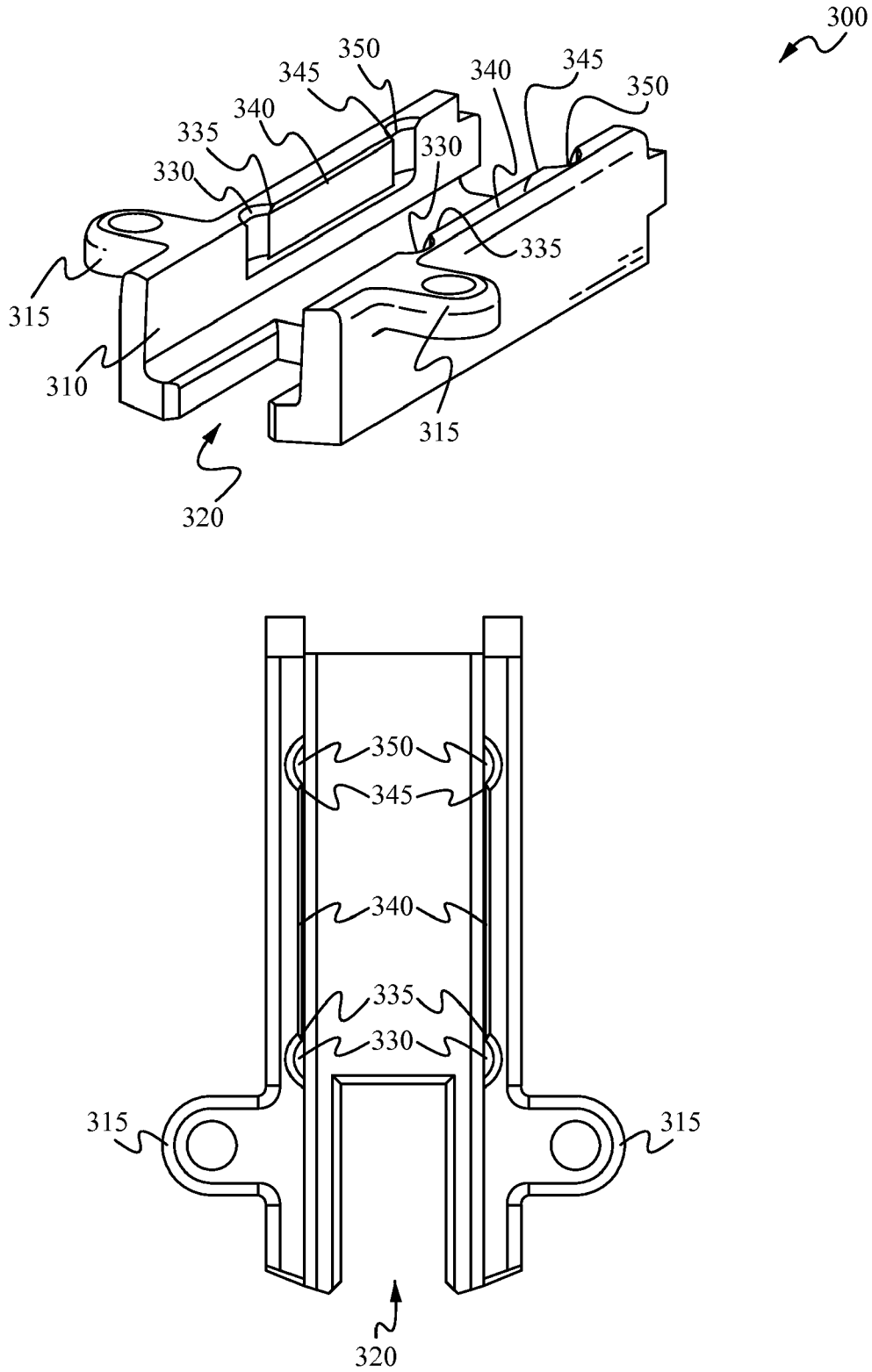
FIG. 3 shows a fitting for an earth pin of a Type G power connector per an embodiment of the current invention.

FIG. 2A shows an angled view and a top cross sectional perspective of an earth pin 200 of a Type G power connector. The earth pin 200 comprises an insertion portion 210 for coming into contact with the female earth contactor in a wall plug (not shown). The earth pin 200 further comprises a sliding portion 220 and an insertion portion 210. The insertion portion 210 is preferably configured to conform to BS 1363 requirements, or any other standard for which the earth pin 200 is adapted for. As will be made evident below, the sliding portion 220 enables the motion of the earth pin 200 into two distinct positions: a small form factor position and an operational position. To that end, an assembly 215 at the base of the sliding portion 220 is configured to receive a spring latching member 240 as shown in FIG. 2B. Referencing FIG. 2B, the spring latching member 240 is constructed of an elastic yet robust material such as metal or plastic such that latching protrusions 245 are able to bend back into spaces 216 formed on the assembly 215 when the sliding portion 220 is moving slidably within a fitting (FIG. 3). The protrusions 245 should be able to spring back out of the spaces 216 when the position of the sliding portion 220 coincides with latching grooves sized and configured appropriately to receive the protrusions 245.

Figure 5A:
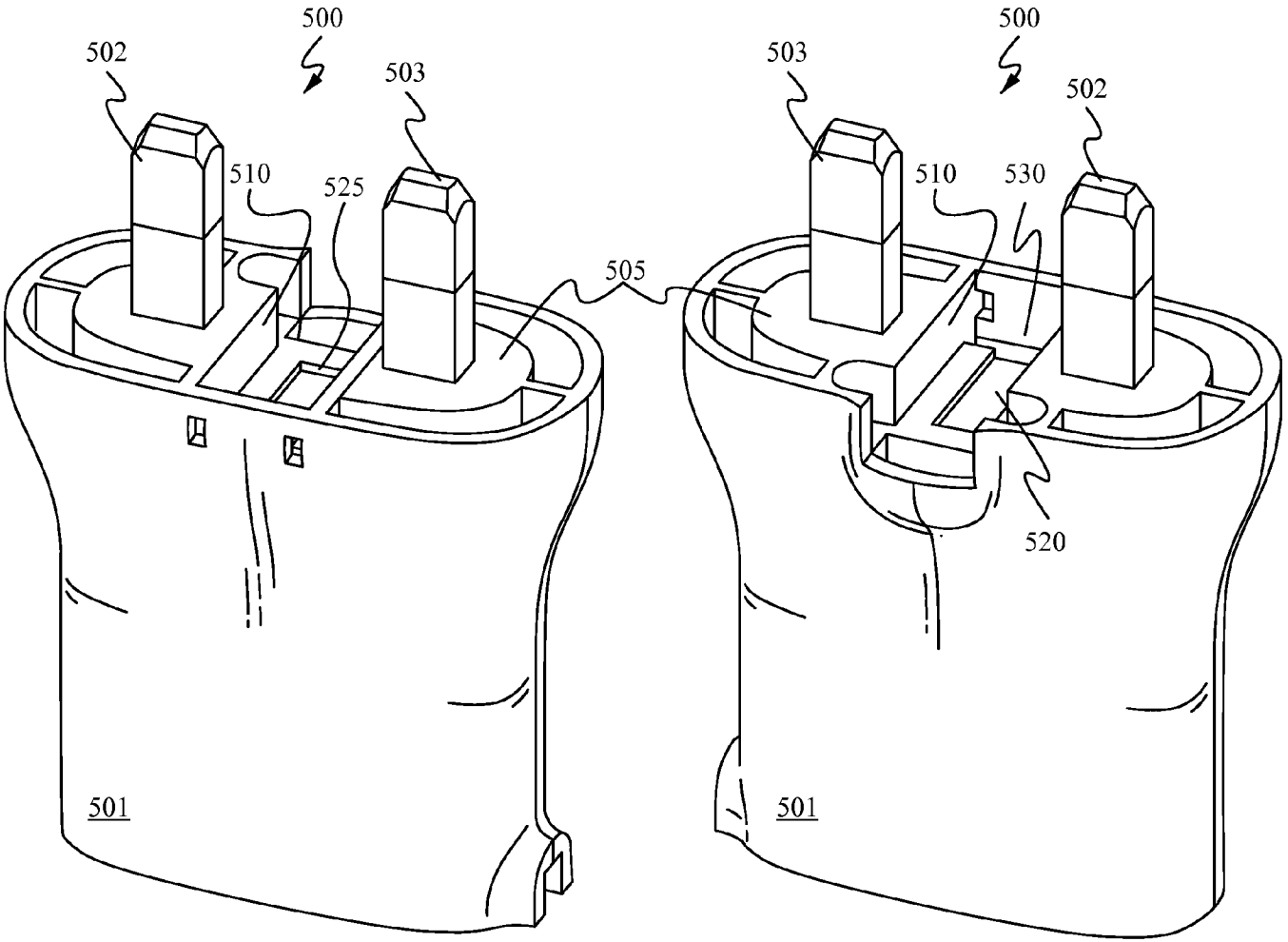
FIG. 5A shows a Type G connector housing per an embodiment of the current invention.

FIG. 3 shows an angled view and a top cross sectional view, respectively, of a fitting 300 for receiving the sliding portion 220 of the earth pin 200 of FIGS. 2A and 2B in accordance with one embodiment of this invention. The fitting 300 is configured to fit in a housing for a large form factor power socket (FIG. 5A). The fitting 300 preferably comprises a sliding path 310 that is sized and configured for receiving the sliding portion 220 of the earth pin 200 of FIGS. 2A and 2B. A notch 320 is cut into the sliding path 310 to form a resting place for the base of the insertion portion 210 in a small form factor position. The side surfaces of the sliding path 310 comprise a variety of grooves. Each set of grooves is preferably symmetrically across from each other with respect to a bisecting line along the sliding path 310. The first set of grooves 330 is configured such that each groove is sized to receive one latching protrusion (245, FIG. 2B) in a snug and tight fit. Advantageously, the snug and tight fit will cause the earth pin 200 to remain in a position such that the sliding portion 220 of the earth pin 200 will protrude outwardly from the housing (501, FIG. 5A) of the connector. As a result, the earth pin 200 and the plug will be in an operational form factor. Between the first set of grooves 330 and the elongated guides 340, a first set of detents 335 prevents unwanted motion of the sliding portion 220 of the earth pin 200 unless a user applies sufficient force to overcome a spring constant of the spring latching member 240 such that the latching protrusions 245 recess into the spaces 216. When the latching protrusions 245 are so recessed, the overall thickness of the sliding portion 220 is reduced and the earth pin 200 is able to move along the guides 340. The guides 340 are elongated with respect to the grooves in first set of grooves 300, enabling the sliding portion 220 of the earth pin 200 to move freely between an operational form factor and a small form factor. The guides 340 are preferably smooth and substantially planar surfaces, but a any structure can be included for guiding the latching protrusions 245 accordingly. A second set of detents 345 provide a stopping point for the movement of the sliding portion 220. Again, when a user overcomes the spring constant of the spring latching member 240, the protrusions 245 are pushed back into the spaces 216 and the sliding portion 220 achieves minimal thickness. Then, the latching protrusions 245 are able to latch into a second set of grooves 350. The fitting 300 further comprises means to mount the fitting 300 to a housing. In this example, two screw holes 315 are provided. The person of ordinary skill having the benefit of this disclosure will appreciate several other means of mounting the fitting 300 to a housing.

Figure 4A:
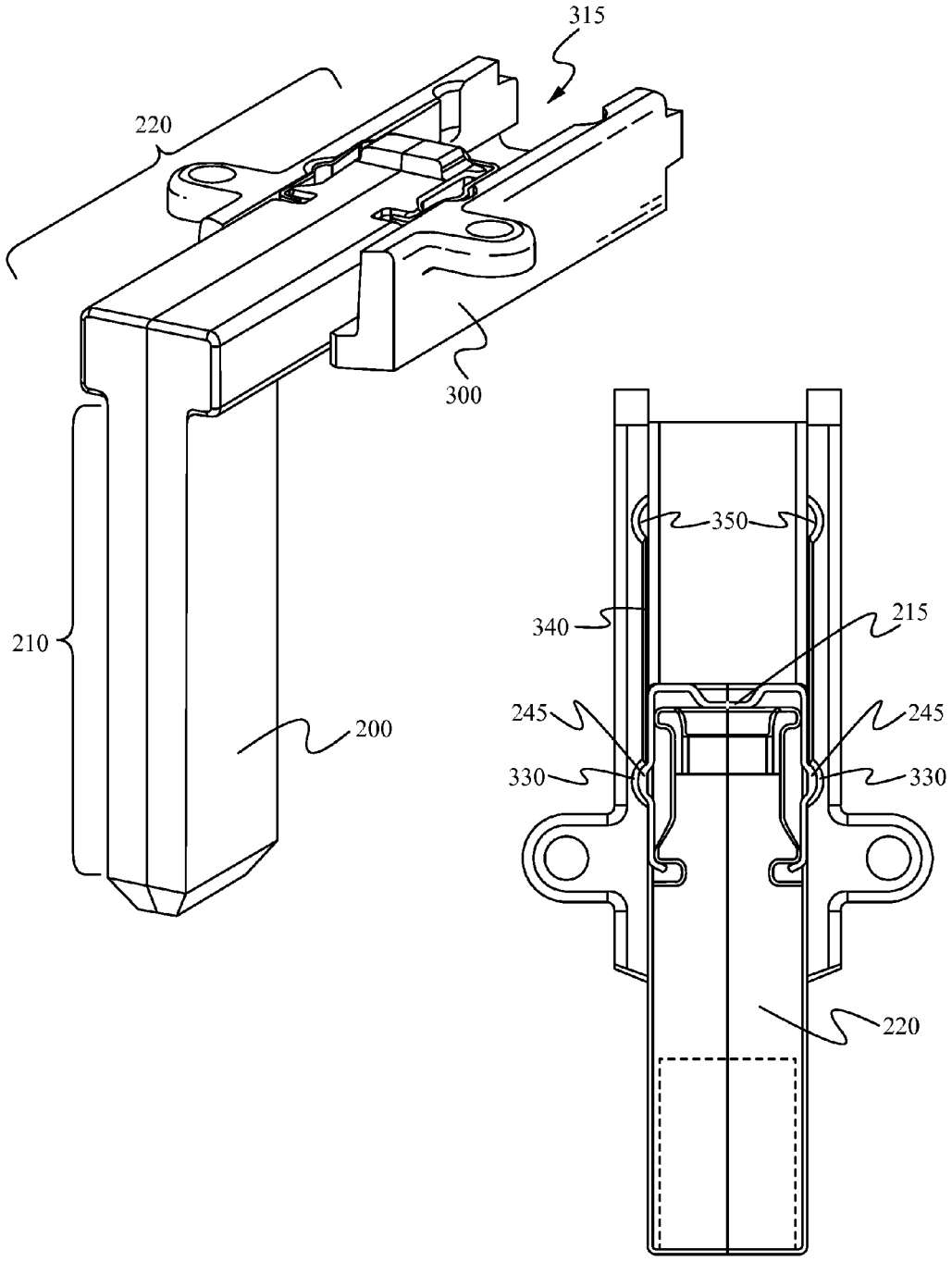
FIG. 4A shows the earth pin of FIG. 2 cooperating with the fitting of FIG. 3 in an operational form factor.
Figure 4B:
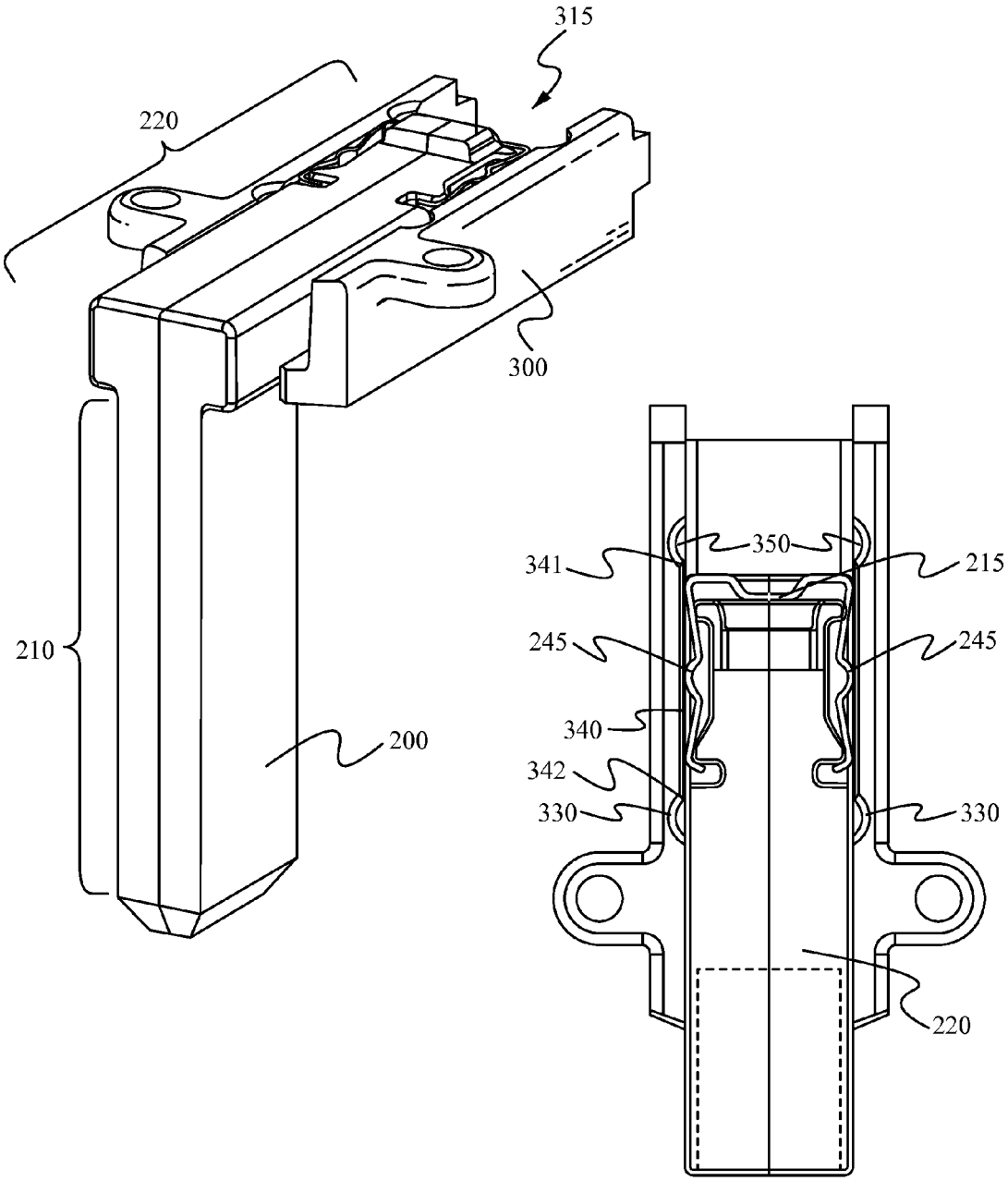
FIG. 4B shows the earth pin of FIG. 2 cooperating with the fitting of FIG. 3 in an intermediate form factor.
Figure 4C:
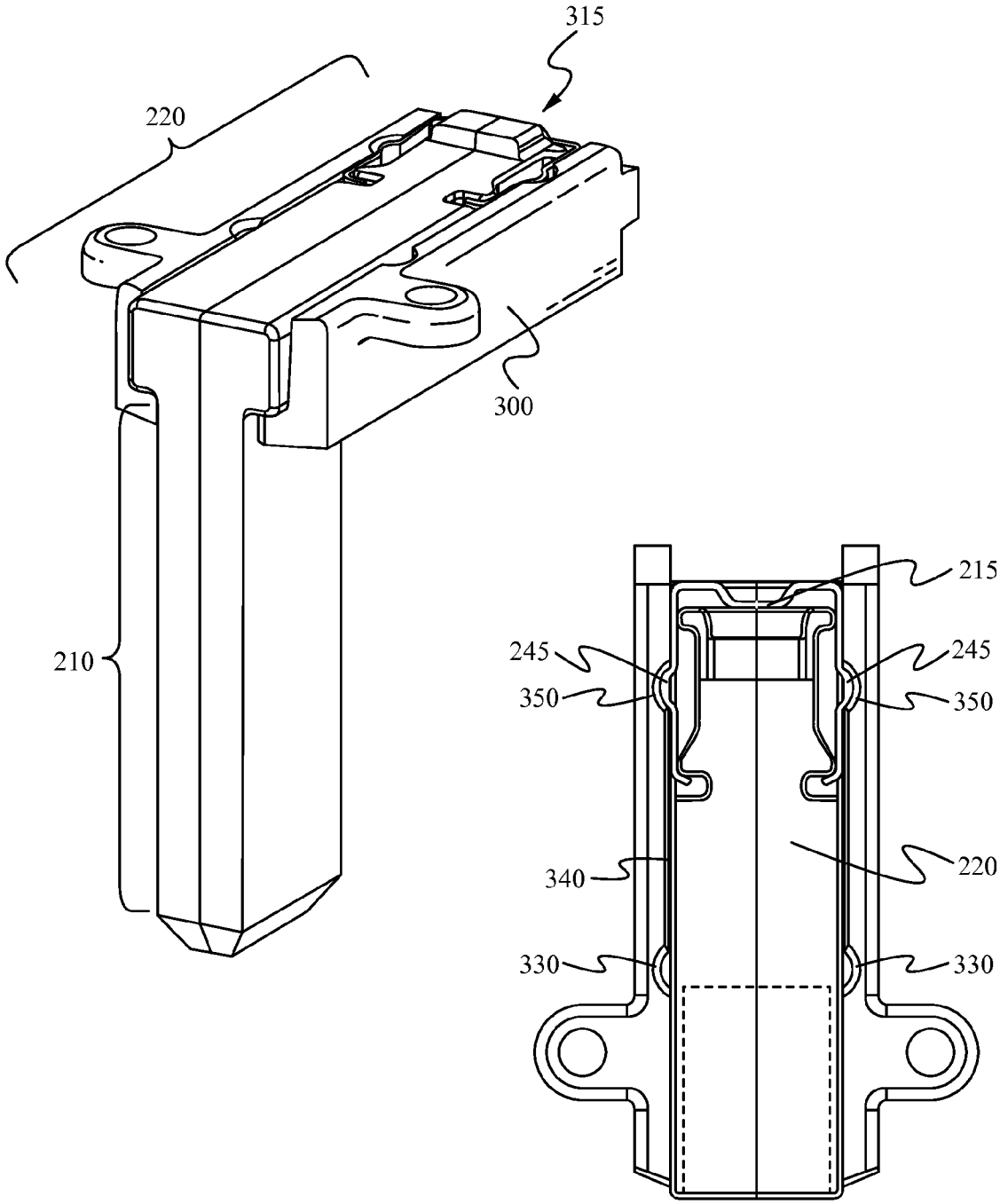
FIG. 4C shows the earth pin of FIG. 2 cooperating with the fitting of FIG. 3 in a travel form factor.

FIGS. 4A through 4C show the earth pin 200 mated with the fitting 300 in an operational form factor, an intermediate or sliding form factor and a travel form factor respectively. In FIG. 4A, the sliding portion 220 of the earth pin 200 fits into the sliding path 310 of FIG. 3 and the latching protrusions 245 are mated with the first set of grooves 330, placing the earth pin 200 in an operational form factor, meaning that the earth pin 200 is extended and positioned to fit within a socket appropriately. The first set of detents (335, FIG. 3) hold the latching protrusions 245 in position until sufficient force is applied to overcome the inherent spring constant in the spring member 215. When such force is applied, the sliding portion 220 leaves the operational form factor. In FIG. 4B, the latching protrusions 245 are positioned within the elongated guides 340. The latching protrusions 245 are recessed into the spaces 216 shown in FIG. 2A. As can be seen, the sliding portion 220 can move freely in between two latched positions that are defined when the protrusions 245 are mated within one of the first set of grooves 330 and the second set of grooves 350. When force is applied by a user in either direction along the sliding path 310, the latching protrusions 245 meet one of the first end 341 or the second end 342. Because the ends are rounded according to the shape of the protrusions 245, the spring constant of the spring latching member 215 is able to be overcome by a user and the protrusions 245 recess into the spaces 216. As a result, the thickness of the sliding portion 220 including the protrusions 245 is reduced to the minimum thickness of the sliding path 310. As the protrusions 245 pass over one of the first set of grooves 330 and second set of grooves 350, the spring constant of the spring latching member 215 forces the protrusions 245 outwardly to mate with the grooves 330 or 350. FIG. 4C shows the earth pin 200 in a travel form factor. The latching protrusions 245 are mated with the second set of grooves 350. As a result, the earth pin 200 is retracted and consumes less space.

FIG. 5A shows a connector 500 per an embodiment of the current invention capable of receiving the fitting 300 of FIGS. 3 and 4. The housing 501 has a contacting surface 505 that comes into contact with a wall socket (not shown). A positive prong 502 and a neutral prong 503 extend outwardly from the contacting surface 505. A cut away portion 510 is preferably sized and configured to receive the fitting 300. Preferably, the cutaway portion 510 comprises a back surface 530. The back surface 530 of FIG. 3 is able to stop any unwanted motion of the earth pin 200 of the previous figures when it is pushed into a small form factor position. On another surface, the cutaway portion 510 comprises a slot 520 having a backstop 525. The backstop 525 stops undesired motion of the earth pin 200 when it is being pulled into an operational form factor.

Figure 5B:
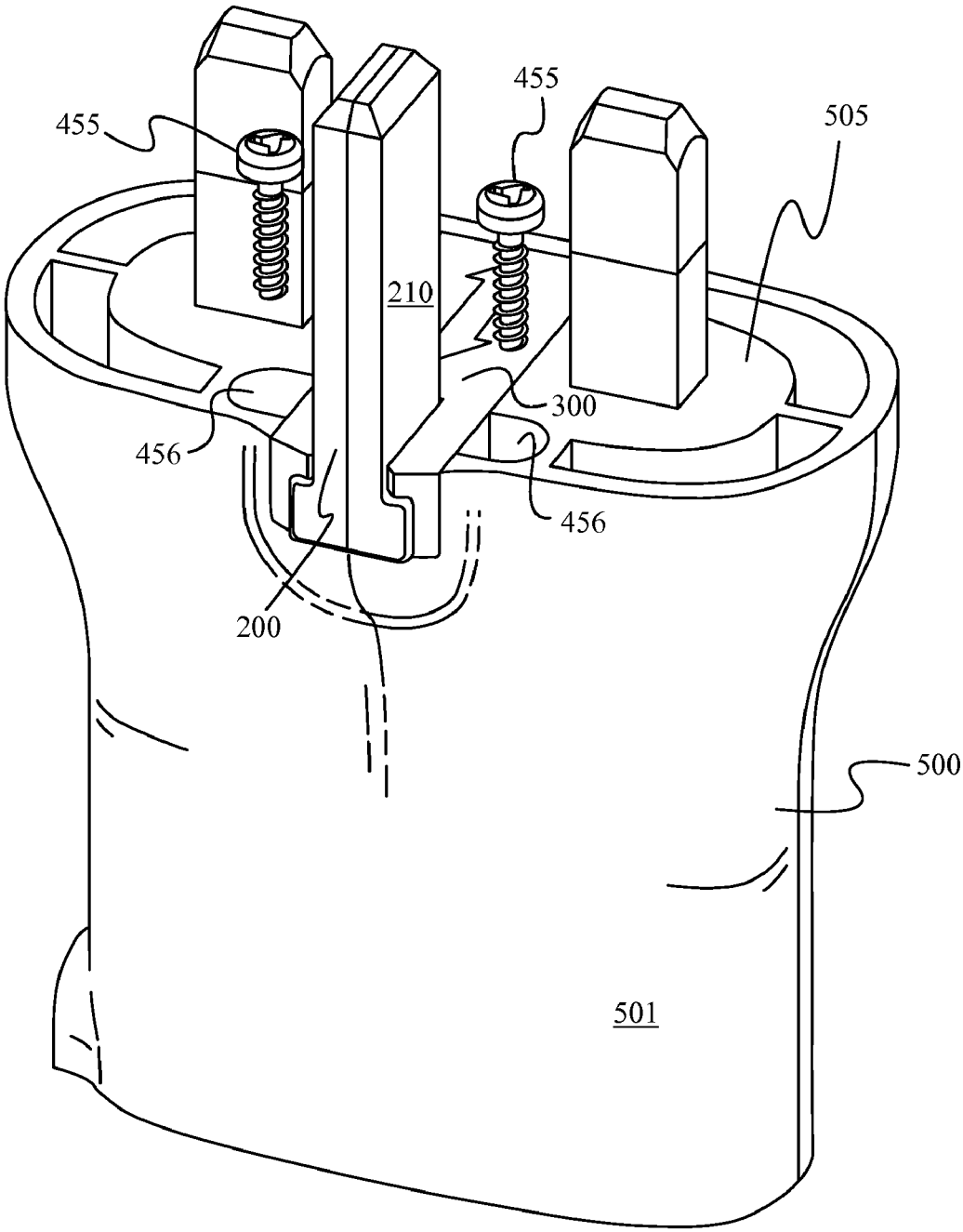
FIG. 5B shows a housing for a Type G connector cooperating with the fitting of FIG. 3.

FIG. 5B shows the fitting 300 cooperating with the housing 501 of the connector 500. The fitting 300 is secured onto the contacting surface 505 with screws 455 that are screwed into the holes 456. The insertion portion 210 of the earth pin 200 extends outwardly from the contacting surface 505.

Figure 5D:
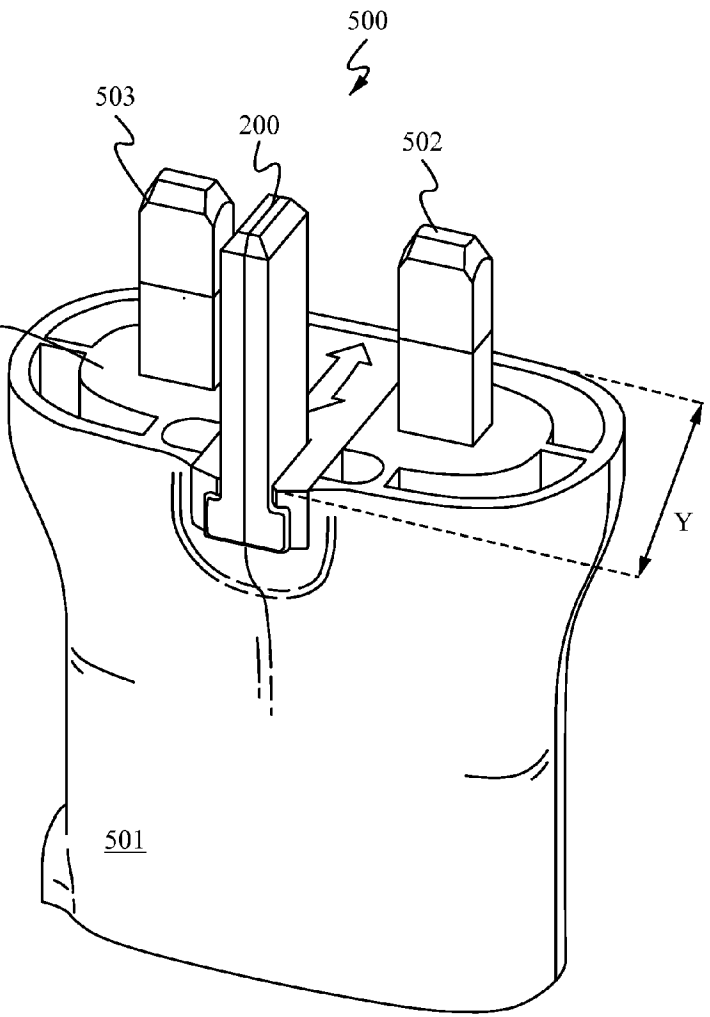
FIG. 5D shows a Type G connector per an embodiment of the current invention, particularly in a small form factor from a second angle.
Figure 5C:
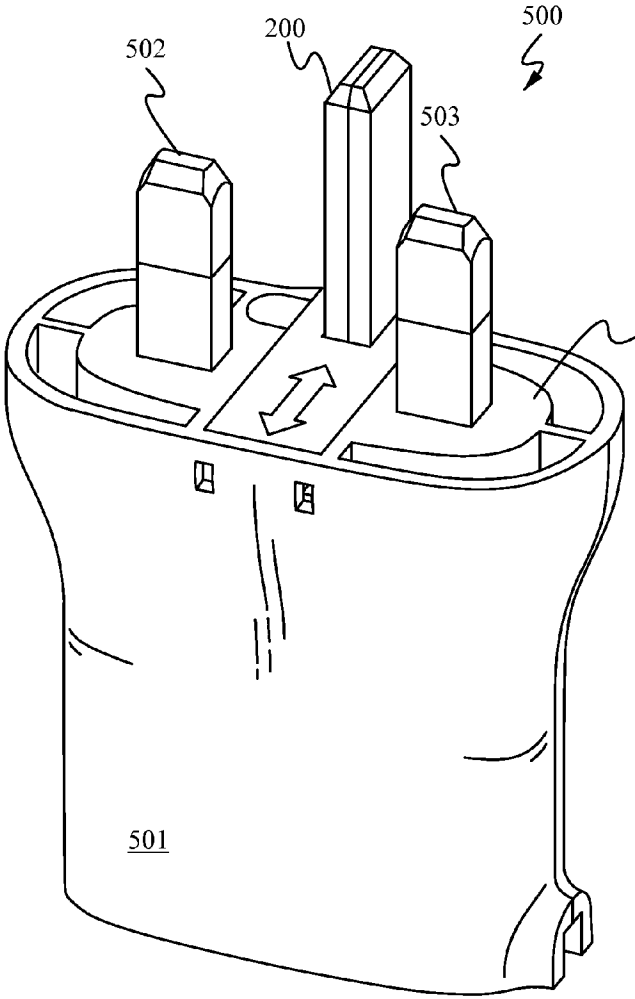
FIG. 5C shows a Type G connector per an embodiment of the current invention, particularly in a small form factor from a first angle.
Figure 5E:
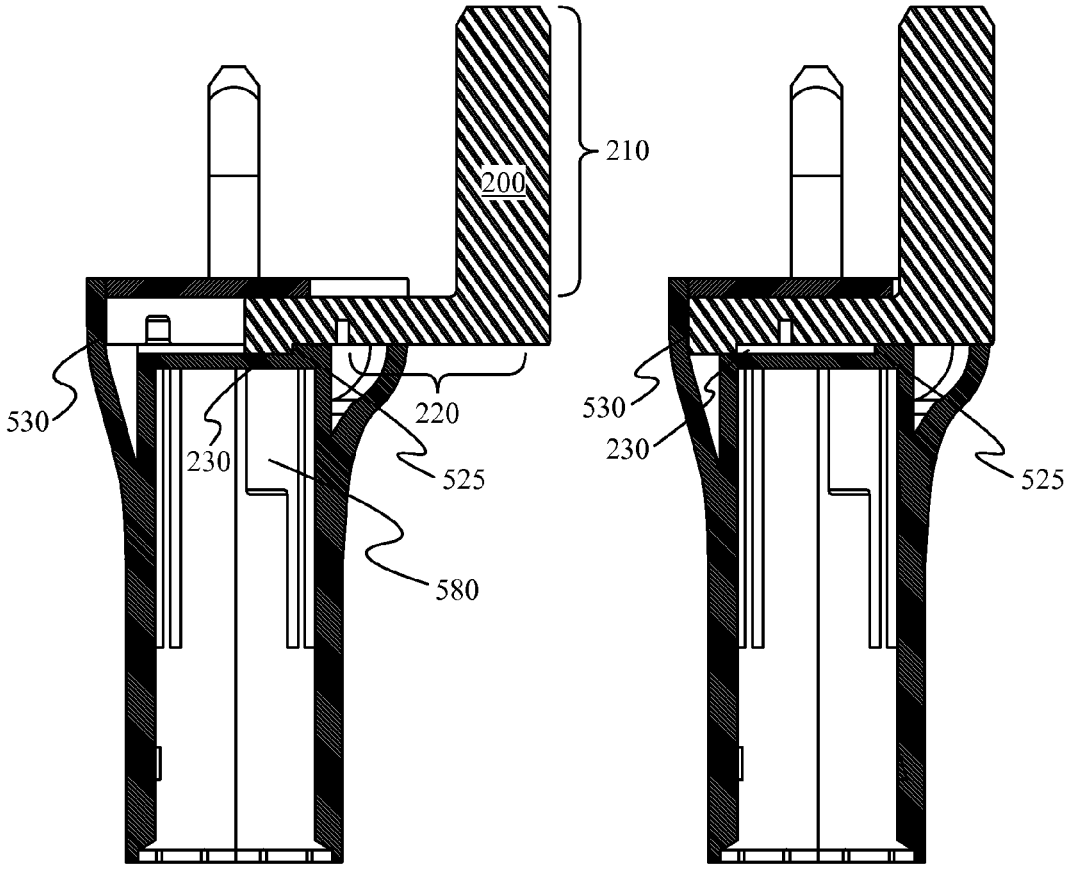
FIG. 5E shows a sliding motion of the earth pin in a Type G connector per an embodiment of the current invention in cross section.
Figure 5F:
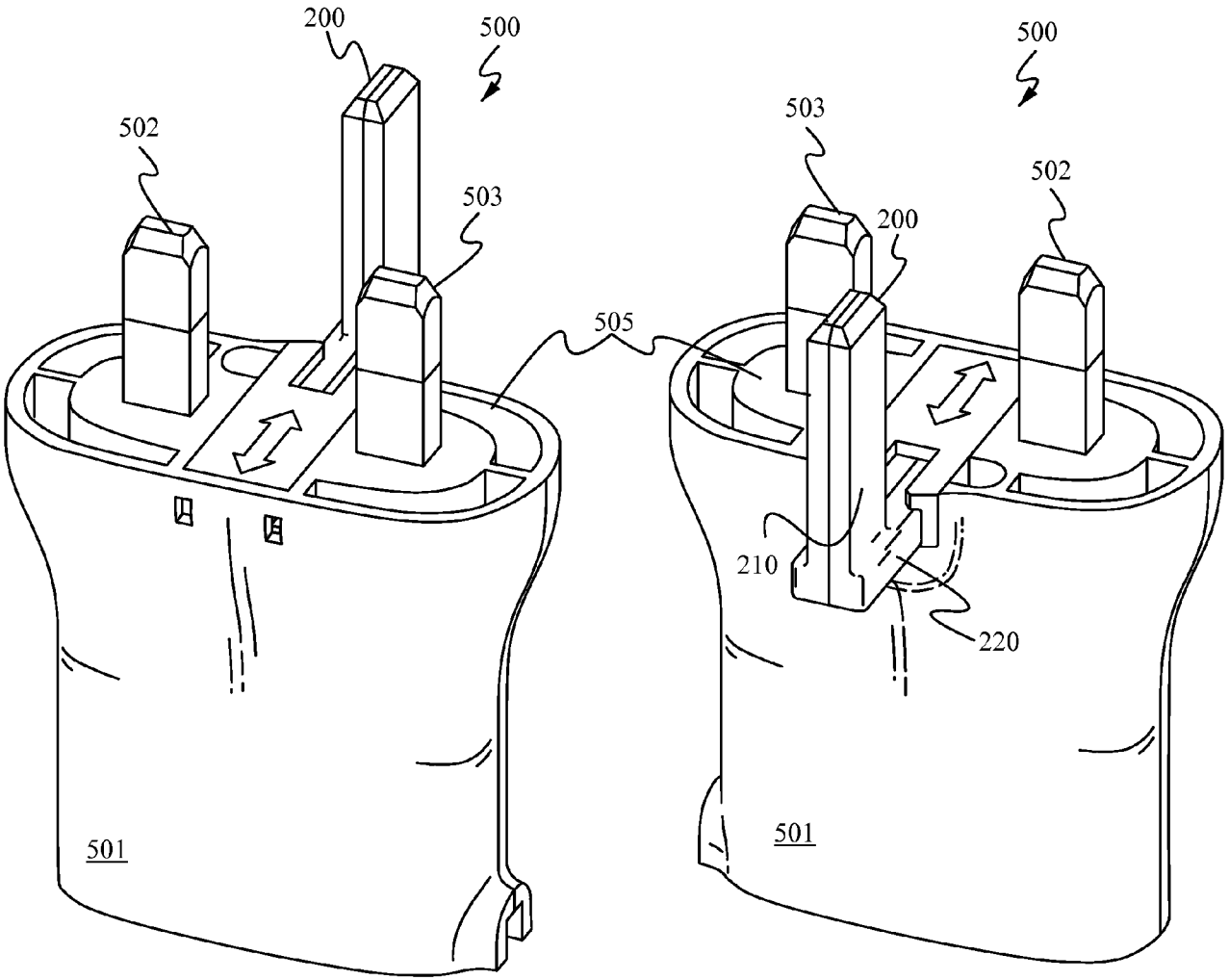
FIG. 5F shows a Type G connector per an embodiment of the current invention, particularly in an operational form factor FIGS. 6 A & B shows a sliding motion of the earth pin in a Type G connector per an embodiment of the current invention in a phantom view.

FIGS. 5C and 5D show the connector 500 with the earth pin 200 in a small form factor from a front and back angle and FIG. 5F shows an operational form factor respectively in both a front and a back view. FIG. 5C shows the earth pin 200 in a small form factor position. The small form factor position is ideal for transit. Users will appreciate that the thickness Y of the connector is greatly reduced with respect to a BS 1363 standard connector. The connector 500 will more readily fit into the pocket of a backpack, briefcase or the like and have a substantially slim form factor, reducing bulk. FIG. 5F shows the connector 500 in an operational form factor. The earth pin 200 is able to extend outwardly, exposing the sliding portion 220. The insertion portion 210 remains pointing outwardly from a plane defined by the contacting surface 505. Preferably, the operational form factor position adheres to BS 1363 with respect to the earth pin 200.

FIG. 5E shows the connector 500 in a bisected side view in both a small form factor and an operational form factor. The earth pin's 200 motion is stopped from exceeding the operational form factor position when the stopping protrusion 230 first shown in FIG. 2A comes into contact with the backstop 525 first shown in FIG. 5A. The back surface 530 first shown in FIG. 5A stops the earth pin 200 from undesired movement past a small form factor position. In some embodiments, the earth pin 200 makes a robust, secure contact with an optional earth pin contactor 580 within the housing 500. The contactor 580 is electrically connected to circuitry within an electrical appliance (not shown) requiring a ground, or earth, connection. FIG. 5F shows the connector 500 in a in an operational form factor, with the earth pin 200 extended in a front and a back view.

Figure 6B:
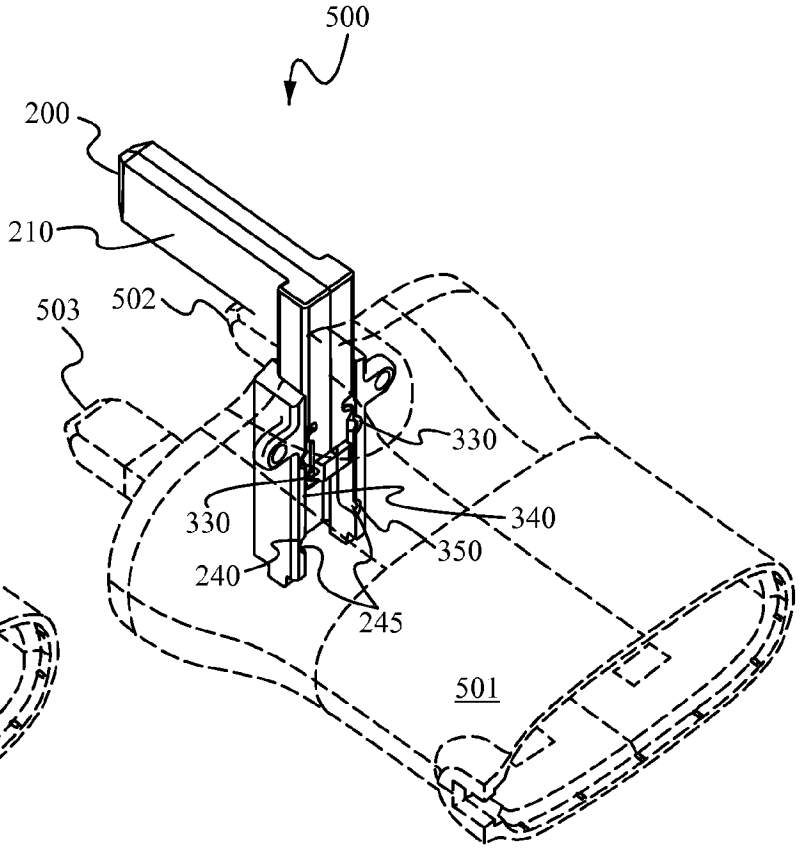
Figure 6A:
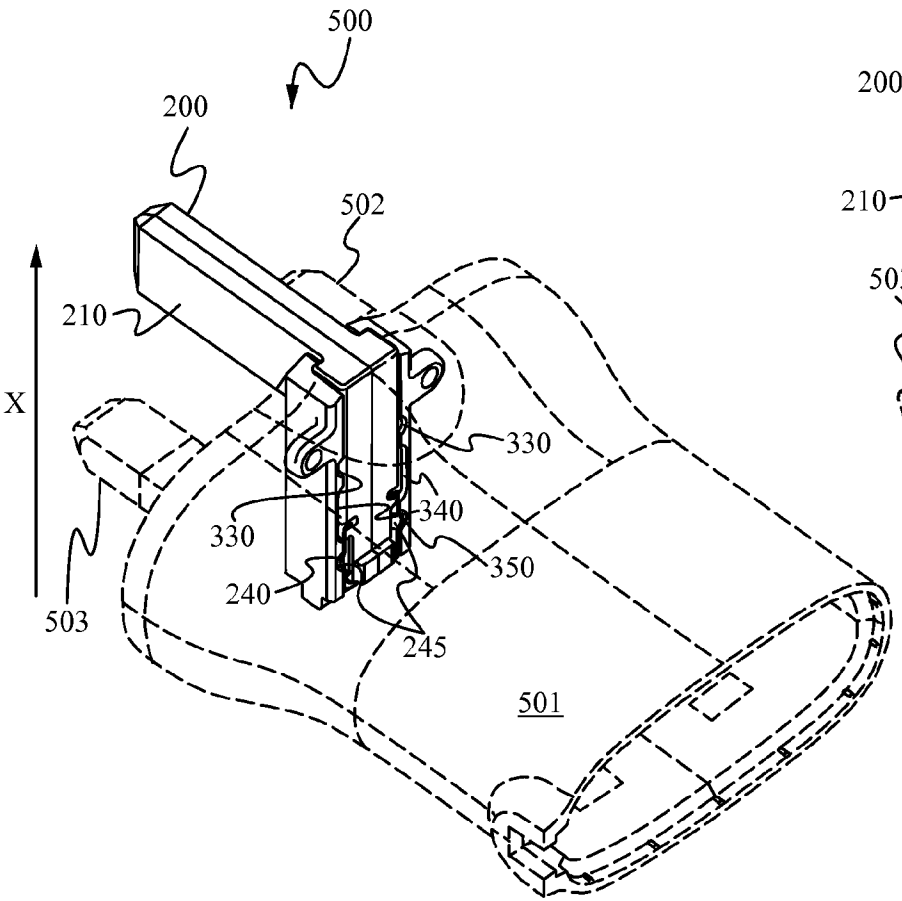

FIGS. 6A and 6B show phantom views of the connector 500 with the earth pin 200 in a small form factor position and an operational form factor position respectively. In FIG. 6A, the locking protrusions 245 on the spring latching member 240 are mated with the second set of grooves 350, thereby latching the earth pin 200 in a small form factor. Force applied to the earth pin 200 by a user along the X axis shown enables sliding motion of the earth pin 200 into the operational form factor position of FIG. 6B. Here, the latching protrusions are mated with the first set of contacts 330.

As mentioned above, the embodiments presented in the several figures depict a BS 1363 "Type G" connector. However, a person of ordinary skill having the benefit of this disclosure will readily appreciate that the latching, slidably movable earth or ground pin, or any other pin, is able to be used with a great variety power or signal connectors. The present invention has been described in terms of specific embodiments incorporating details to facilitate the understanding of the principles of construction and operation of the invention. The specific configurations shown in relation to the various modules and the interconnections therebetween are for exemplary purposes only. Such reference herein to specific embodiments and details thereof is not intended to limit the scope of the invention as defined by claims appended hereto. It will be apparent to those skilled in the art that modifications may be made in the embodiment chosen for illustration without departing from the spirit and scope of the invention.

What is claimed is:

1. A connector for a wall power socket comprising:

a. a housing having a surface for facing a wall power socket, wherein the housing comprises a fitting for receiving the earth pin and effectuating a sliding motion, the fitting having:

i. a slot for defining a sliding path for the earth pin;

ii. a first set of grooves for holding the earth pin in a first position; and iii. a second set of grooves for holding the earth pin in a second position;

b. a positive prong extending outwardly from the surface for facing a wall power socket;

c. a negative prong extending outwardly from the surface for facing a wall power socket; and d. an earth pin extending outwardly from the surface for facing a wall power socket, wherein the earth pin is slidably positionable in the first and the second position, wherein the earth pin comprises a spring member having an elastic structure surrounding at least a portion of the earth pin.

2. The connector of claim 1 wherein the earth pin extends outwardly from the surface for facing a wall power socket in both the first and the second position.

3. The connector of claim 1 wherein in the first position, the connector is in a small form factor.

4. The connector of claim 1 wherein in the second position, the connector is in an operational form factor.

5. The connector of claim 1 wherein the fitting further comprises an elongated planar guide positioned between the first and second sets of grooves.

6. The connector of claim 1 wherein the earth pin comprises a spring latching member, the spring latching member having a set of protrusions, wherein the protrusions are configured to fit into one of the first and second sets of grooves, thereby selectively holding the earth pin in the first and the second position respectively.

7. The connector of claim 1 wherein the set of protrusions is configured to enable a sliding motion along the set of elongated grooves.

8. The connector of claim 1 further comprising locking edge along a sliding path for preventing unwanted motion of the earth pin.

9. The connector of claim 8 wherein the earth pin comprises a stopping protrusion for coming into contact with the locking edge and preventing unwanted motion of the earth pin.

10. A system comprising:

a. an electrical appliance; and b. a type G power plug connector electrically coupled to the electrical appliance, the connector having:

i. a housing comprising a latching mechanism; and ii. a positive lead, a negative lead, and an earth pin extending outwardly from the housing, wherein the earth pin is slidably settable in two discrete positions and comprises a spring member having an elastic structure surrounding at least a portion of the earth pin, and wherein the latching mechanism is configured to hold the earth pin in the two discrete positions and comprises:

(1) a first set of grooves along a sliding path for holding the earth pin a first position; and (2) a second set of grooves along the sliding path for holding the earth pin in a second position.

11. The system of claim 10 wherein the earth pin comprises a spring mechanism, the spring mechanism having a spring actuated let of protrusions for coming to rest in one of the first and second set of grooves.

12. The system of claim 10 wherein the earth pin comprises a stopping protrusion, and the housing comprises a stopping edge along the sliding path for stopping the earth pin from unintended movement.

* * * * *